US012434889B2

(12) United States Patent
Farren

(10) Patent No.: US 12,434,889 B2
(45) Date of Patent: Oct. 7, 2025

(54) SEALING SYSTEMS

(71) Applicant: Instrumentation Laboratory Company, Bedford, MA (US)

(72) Inventor: Christopher Farren, Concord, MA (US)

(73) Assignee: Instrumentation Laboratory Company, Bedford, MA (US)

( * ) Notice: Subject to any disclaimer, the term of this patent is extended or adjusted under 35 U.S.C. 154(b) by 0 days.

(21) Appl. No.: 18/078,849

(22) Filed: Dec. 9, 2022

(65) Prior Publication Data

US 2024/0190627 A1 Jun. 13, 2024

(51) Int. Cl.
*B65D 51/20* (2006.01)

(52) U.S. Cl.
CPC ..... *B65D 51/20* (2013.01); *B65D 2251/0015* (2013.01); *B65D 2251/0043* (2013.01); *B65D 2251/009* (2013.01); *B65D 2251/205* (2013.01); *B65D 2517/0043* (2013.01); *B65D 2517/5032* (2013.01)

(58) Field of Classification Search
CPC ..... B65D 51/20; B65D 2251/0015; B65D 2251/0043; B65D 2251/009; B65D 2251/205; B65D 2517/0043; B65D 2517/5032; B01L 3/50825
See application file for complete search history.

(56) References Cited

U.S. PATENT DOCUMENTS

| | | | | |
|---|---|---|---|---|
| 811,811 | A * | 2/1906 | Allison | B65D 51/002 251/149.3 |
| 2,848,130 | A | 8/1958 | Jesnig | |
| 3,480,171 | A | 11/1969 | Rohde | |
| 3,823,840 | A * | 7/1974 | Zackheim | B65D 51/002 215/250 |
| 4,366,912 | A | 1/1983 | Matukura et al. | |
| 4,545,497 | A | 10/1985 | Martha, Jr. | |
| 4,664,274 | A * | 5/1987 | Konrad | B01L 3/50825 215/247 |
| 4,872,572 | A | 10/1989 | Schrooten | |

(Continued)

FOREIGN PATENT DOCUMENTS

| | | | |
|---|---|---|---|
| CN | 104107647 | A | 10/2014 |
| CN | 104107733 | A | 10/2014 |

(Continued)

OTHER PUBLICATIONS

Extended European Search Report in Application No. 23215164.7 dated Apr. 15, 2024, 9 pages.

(Continued)

*Primary Examiner* — James N Smalley
(74) *Attorney, Agent, or Firm* — ArentFox Schiff LLP

(57) ABSTRACT

The embodiments of the present disclosure provide a stopper comprising a plug and a pierceable membrane, the plug including a cavity between a pierceable membrane and a lower opening. The pierceable membrane and the cavity can form a tortuous path that reduces interactions between the contents of the container and the ambient environment. The cavity can be bounded by a plastic insert disposed within the plug. The plastic insert can include insert walls, the lower opening, and an insert flange. The pierceable membrane can be bonded to an upper surface of the insert flange.

18 Claims, 7 Drawing Sheets

(56) References Cited

U.S. PATENT DOCUMENTS 5,125,921 A 6/1992 Duschek
5,202,093 A * 4/1993 Cloyd ..... B01L 3/50825 435/288.1
5,275,299 A * 1/1994 Konrad ..... B65D 51/002 215/261
5,279,606 A 1/1994 Haber et al.
5,297,599 A * 3/1994 Bucheli ..... G01N 35/1002 141/330
5,484,566 A 1/1996 Gabbard
5,494,170 A 2/1996 Burns
5,514,339 A * 5/1996 Leopardi ..... A61B 5/154 604/3
5,578,272 A 11/1996 Koch et al.
5,738,233 A * 4/1998 Burns ..... B01L 3/50825 215/249
5,817,082 A 10/1998 Niedospial et al.
5,819,964 A 10/1998 Grimard
5,947,274 A 9/1999 Taskis et al.
6,223,918 B1 5/2001 Browne
6,286,699 B1 9/2001 Sudo
6,322,739 B1 11/2001 Andersson et al.
6,893,612 B2 * 5/2005 Kacian ..... B01L 3/50825 422/570
7,727,474 B2 6/2010 Reinhard
7,850,919 B2 12/2010 Renslow
7,934,614 B2 5/2011 Finneran
8,448,800 B2 5/2013 Konrad
8,567,609 B2 10/2013 Landrigan et al.
9,039,999 B2 5/2015 Campton et al.
9,061,281 B2 6/2015 Sandra et al.
9,138,205 B2 9/2015 El-Fahmawi
9,174,779 B2 11/2015 Boeckeler
9,339,818 B2 5/2016 Cayre
9,459,187 B2 10/2016 Craft et al.
9,493,274 B2 11/2016 Ledun et al.
9,518,898 B2 12/2016 Jimenez-Rios
9,580,217 B2 2/2017 Niunoya et al.
9,757,095 B2 9/2017 Terbrueggen et al.
10,123,939 B2 11/2018 Gobbi Frattini
10,166,009 B2 1/2019 Saqi et al.
10,182,967 B2 1/2019 Niunoya et al.
10,371,606 B2 8/2019 Holmes et al.
10,537,892 B2 1/2020 Blake et al.
10,625,255 B2 4/2020 Tajima
10,737,855 B2 8/2020 Christensen et al.
10,767,146 B2 9/2020 Yang-Woytowitz et al.
11,319,122 B2 5/2022 Farren et al.
2001/0002013 A1 5/2001 Claessens et al.
2002/0142124 A1 10/2002 Muraki
2003/0087443 A1 5/2003 Pressman et al.
2004/0043505 A1 3/2004 Walenciak et al.
2004/0217081 A1 11/2004 Konrad
2005/0065454 A1 3/2005 Manoussakis
2006/0191594 A1 8/2006 Py
2007/0102393 A1 5/2007 Colin et al.
2007/0183937 A1 8/2007 Sarstedt
2008/0017577 A1 1/2008 Yi et al.
2008/0023414 A1 1/2008 Konrad
2009/0166311 A1 7/2009 Claessens
2010/0089862 A1 4/2010 Schmitt
2011/0266249 A1 11/2011 Kakutani et al.
2012/0067888 A1 3/2012 Kawachi
2013/0119011 A1 5/2013 Kawachi
2013/0164738 A1 6/2013 Becker et al.
2013/0270271 A1 10/2013 Asai et al.
2014/0008321 A1 1/2014 Lentz et al.
2015/0037833 A1 2/2015 Fisher et al.
2015/0112296 A1 4/2015 Ishiwata et al.
2016/0200488 A1 7/2016 Friedrich et al.
2017/0057705 A1 3/2017 Bailey
2017/0173266 A1 6/2017 Ashmead et al.
2018/0202992 A1 7/2018 Speziale
2019/0381498 A1 12/2019 Fruchter et al.
2020/0367866 A1 11/2020 Odon
2021/0223276 A1 7/2021 Xie et al.
2021/0291162 A1 9/2021 Saukkonen et al.
2021/0402406 A1 12/2021 Theberge et al.
2022/0008916 A1 1/2022 Senda et al.
2022/0040650 A1 2/2022 Xu et al.
2022/0073966 A1 3/2022 DeJohn et al.
2022/0080404 A1 3/2022 Haj-Ahmad
2023/0008204 A1 1/2023 Farren et al.

FOREIGN PATENT DOCUMENTS

CN 204351906 U 5/2015
CN 206046075 U 3/2017
CN 107157496 A 9/2017
CN 208224273 U 12/2018
CN 109939599 A 6/2019
CN 110360795 A 10/2019
CN 209617877 U 11/2019
CN 110892245 A 3/2020
CN 210710667 U 6/2020
CN 112067830 A 12/2020
CN 212301590 U 1/2021
CN 112585445 A 3/2021
CN 112654849 A 4/2021
CN 112932484 A 6/2021
CN 113015910 A 6/2021
CN 214585483 U 11/2021
CN 214622684 U 11/2021
CN 113759140 A 12/2021
CN 113994210 A 1/2022
CN 215641308 U 1/2022
CN 216696346 U 6/2022
CN 217962597 U 12/2022
CN 116068209 A 5/2023
CN 116087539 A 5/2023
CN 116087540 A 5/2023
CN 116265140 A 6/2023
CN 116265141 A 6/2023
DE 10105753 C1 3/2002
DE 10336523 A1 2/2005
DE 10340538 B4 4/2005
EP 0564037 A1 10/1993
EP 0564670 A2 10/1993
EP 0623523 A1 11/1994
EP 4083634 A1 11/2022
EP 4198520 A2 6/2023
GB 2409411 A 6/2005
JP 5913071 B2 4/2016
TW 223593 B 5/1994
WO 94/15850 A1 7/1994
WO 2002062474 A2 8/2002
WO 2004026695 A2 4/2004
WO 2009021257 A1 2/2009
WO 2013053620 A9 11/2013
WO 2014051037 A1 4/2014
WO 2020098641 A1 5/2020
WO 2022172018 A1 8/2022

OTHER PUBLICATIONS

Communication pursuant to Rules 161(1) & 162 for European Application No. 20703320.0, dated Aug. 11, 2021, (3 pages).
International Preliminary Report on Patentability dated Jul. 15, 2021 for International Application No. PCT/US2020/012032, 7 pgs.
International Search Report and Written Opinion for International Application No. PCT/US2020/012032, dated Mar. 19, 2020, 11 pages.
Office Action received for European Patent Application No. 20703320.0, mailed on Oct. 23, 2023, 6 pages.
Response to Communication pursuant to Rules 161 (1) & 162 for European Application No. 20703320.0, filed Oct. 25, 2021, (7 pages).

* cited by examiner

SEALING SYSTEMS

BRIEF DESCRIPTION OF THE DRAWINGS

The accompanying drawings, which are incorporated into and constitute a part of this specification, illustrate disclosed embodiments and, together with the description, serve to explain the disclosed embodiments. In the drawings.

DETAILED DESCRIPTION

Figure 1:
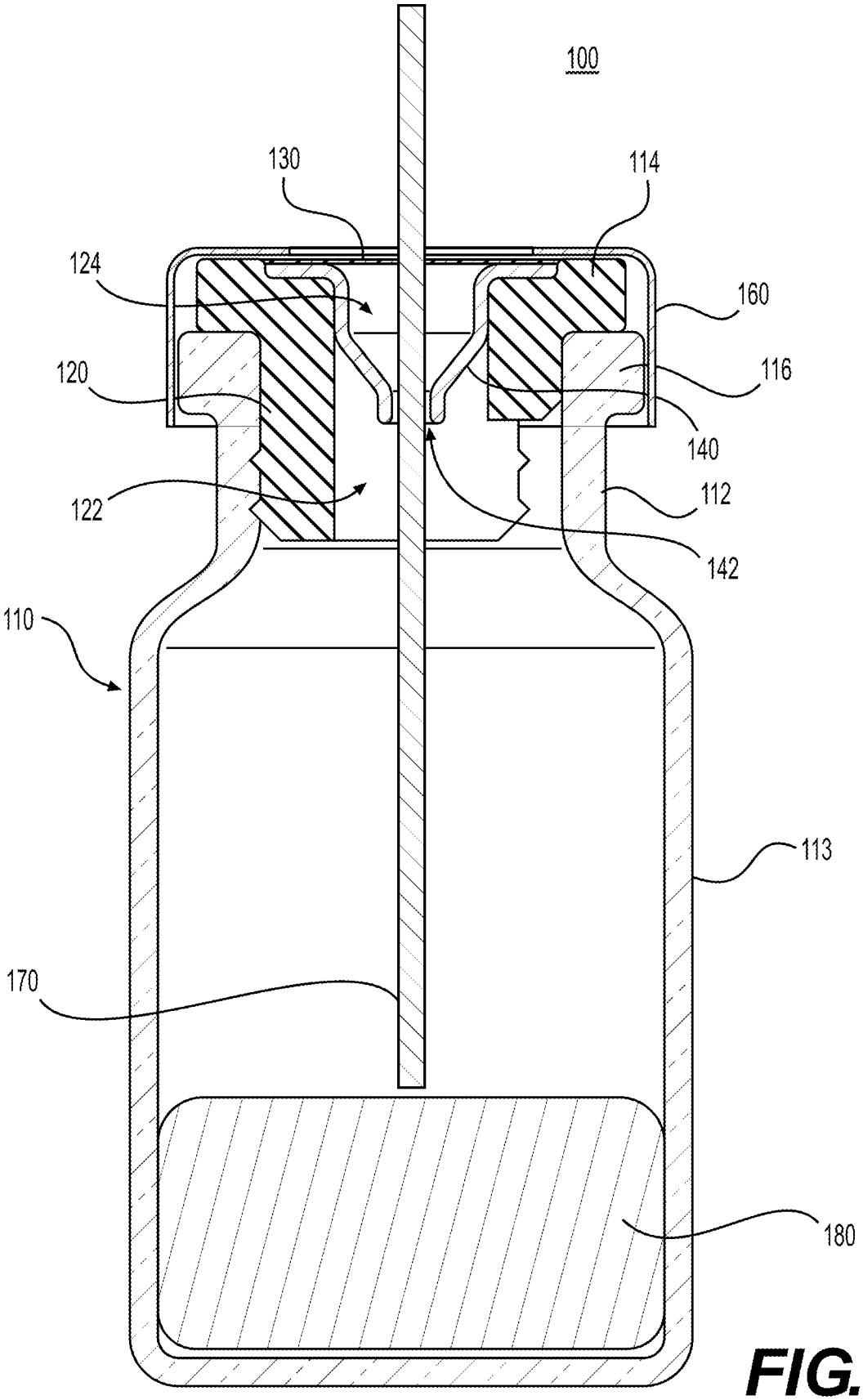
FIG. 1 depicts an exemplary system including a container, sealing system, and probe, consistent with the embodiments of the present disclosure.

Exemplary embodiments are described with reference to the accompanying drawings. While examples and features of disclosed principles are described herein, modifications, adaptations, and other implementations are possible without departing from the spirit and scope of the disclosed embodiments. Exemplary embodiments described herein may be independent of each other. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. It should also be noted that as used herein and in the appended claims, the singular forms "a," "an," and "the" include plural references unless the context clearly dictates otherwise. For convenience, the term "disclosed embodiments" or "exemplary embodiment" may be used herein to refer to a single embodiment or multiple embodiments of the disclosure.

Materials for use in diagnostic testing are often packaged and stored in containers (e.g., reagent materials may be packaged in a sealed vial). A probe system, e.g., an automated probe system, may interface with such a container during use (e.g., to aspirate reagent materials from the vial in preparation for one or more tests). A probe system may perform multiple tests using materials stored in the same containers, requiring multiple aspirations from these containers. Multiple aspirations may require repeated penetrations of the seal. But repeated penetrations of conventional seals, (e.g., stoppers or the like) can reduce the reliability of diagnostic testing. For example, repeated penetrations of conventional stoppers can cause stopper coring and fragmentation. Stopper coring and fragmentation can interfere with reagent aspiration; expose reagent materials in the container to the ambient environment (e.g., through air holes in the stopper), which can reduce the lifetime (e.g., following the initial penetration of the stopper) of the reagent materials stored inside the primary container (e.g., the onboard stability of the reagent materials); and can interfere with subsequent testing and analyses (e.g., by causing errant measurement results due to undetected debris mixed with materials under test).

An improved sealing system (which can also be called an improved stopper or stopper assembly) can support repeated probe penetration without creating fragments that might interfere with diagnostic testing. The sealing system can include a plug to provide a seal between the side and part of the top of the container and sealing system. The plug can include a central opening (which can also be called a plug cavity) through which the probe may travel. The sealing system can include a pierceable membrane to provide a seal on the top of the plug cavity. The pierceable membrane can isolate materials in a container from the ambient environment prior to initial penetration of the membrane. Including the initial penetration, the pierceable membrane can be configured to support 1-1500 penetrations without fragmentation. The plug, membrane, and an insert placed below the membrane can together form an insert cavity in the stopper. This insert cavity can reduce evaporation of reagent materials within the container (and extend the lifetime or onboard stability of the reagent materials) following initial penetration of the seal. In some embodiments, the sides of the insert can also form a mechanical supporting or centering means for the probe system such that the probe, even when slightly off-axis, can reliably access the materials in the lower compartment through the cavity. In some embodiments, the sides of the insert can form a bushing that reduces lateral displacement of the probe within the container. In some embodiments, the sealing system can include a diaphragm that provides an additional barrier between materials within the container and the ambient environment.

The sealing systems can be suitable for containers storing liquid or dry (e.g., lyophilized, or the like) materials. The sealing system can have sufficient venting capability (e.g., through cutouts in the plug, or other suitable venting mechanisms) to support the lyophilization process. The pierceable membrane can be strong enough to withstand the pressures involved in the lyophilization process and any residual pressure which remains inside the container upon completion of the lyophilization process.

The present disclosure relates generally to sealing systems for use in testing, e.g., diagnostic testing including but not limited to medical (disease/drug), chemical, and/or biological testing/analysis, and systems, devices, and methods of using such sealing systems in such testing. Although the present disclosure describes multiple components (e.g., an insert, a pierceable membrane, a plug, a cap, a diaphragm, etc.) that can be implemented in combination, e.g., assembled or formed as an integral part, in a system, each aspect can be used independently with systems and devices that are not described in this disclosure (e.g., conventional systems and devices). A benefit arising from implementation of one of the multiple aspects can be independent of the implementation of another of the multiple aspects. The present disclosure merely describes the various aspects in a related manner for convenience.

As used herein, the term "probe" may be used interchangeably with the term "needle." The term "probe" may refer to the probe system, or a specific component therein such as a needle. For example, the term "probe" may refer to a needle comprising a thin, hollow metal tube through which fluid can be aspirated and dispensed. Accordingly, the term "probe" may refer generally to a needle or any elongated component comprising a hollow cavity that is capable of puncturing, piercing, and penetrating a structure and aspirating material through the hollow cavity. A probe system may include the probe alone or the probe and other components.

Turning now to the drawings, FIG. 1 depicts an exemplary system 100 including a container 110, sealing system, and probe 170, consistent with the embodiments of the present disclosure. The disclosed embodiments are not limited to containers made from any particular material or combination of materials. In some embodiments, the container can be glass, polymer, metal, or any other suitable material. As shown, container 110 can include a container neck 112 and a container body 113. Container body 113 can contain one or more materials 180, which may be liquid or lyophilized material(s). Container neck 112 can end in a container flange 116 that surrounds an opening in the container.

Consistent with disclosed embodiments, the sealing system can include a stopper and optionally a cap 160. The stopper can include a plug 120 that conforms to an inside surface of container 110. In some embodiments, plug 120 can be configured to conform to an inner wall of a neck of the container (e.g., container neck 112). For example, when container neck 112 has a cylindrical cross-section, a portion of plug 120 can have a conforming cylindrical cross-section. An outer diameter of the cylindrical portion of plug 120 can be larger than the inner diameter of container neck 112, such that inserting plug 120 into container neck 112 forms a seal between the outer wall of plug 120 and the inner wall of container neck 112. In some embodiments, a portion of plug 120 can remain outside container 110 when plug 120 is inserted into container neck 112. This portion can include a plug flange 114 that extends beyond container neck 112. In some embodiments, a lower surface of plug flange 114 can form a seal with an upper surface of container flange 116 when plug 120 is inserted into container neck 112. Consistent with disclosed embodiments, plug 120 can include a plug cavity 122. The stopper can include an insert 140 that extends into plug cavity 122 and forms the walls of insert cavity 124. The stopper can further include a membrane 130 that seals insert cavity 124. Plug 120, insert 140, and membrane 130 can seal the interior of container body 113. Insert 140 can include an opening 142 between insert cavity 124 and the interior of container body 113 (e.g., to allow a probe to extend from outside container 110, through membrane 130, insert cavity 124, and opening 142 to reach the interior of container body 113 to access the stored material(s) 180). In some embodiments, plug 120 (and optionally insert 140) can be secured within container 110 using cap 160. In the depicted embodiment, membrane 130 can isolate material(s) 180 from the ambient environment until penetrated by probe 170. Compared to a stopper that lacks a cavity formed between membrane 130 and opening 142 (e.g., insert cavity 124), the stopper disclosed in FIG. 1 can experience reduced evaporation of material(s) 180 or reduced contamination by the ambient environment of material(s) 180, once the membrane is penetrated.

Figure 2A:
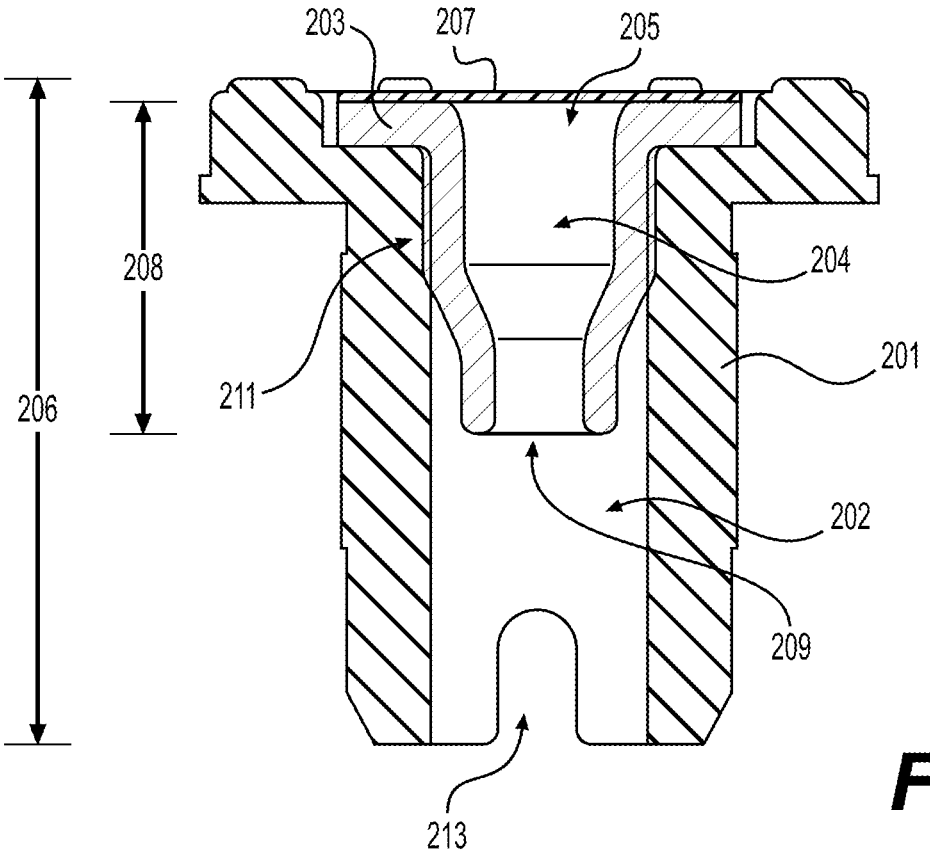
FIG. 2A depicts details of an exemplary sealing system including a plug, membrane, and insert, consistent with disclosed embodiments.

FIG. 2A depicts details of an exemplary sealing system including a plug 201, pierceable membrane 207, and insert 203, consistent with disclosed embodiments. Plug 201 can be configured to conform to an inner wall of a neck of a container. The disclosed embodiments are not limited to plugs made from a particular material or combination of materials. In some embodiments, plug 201 can be manufactured using an elastomeric rubber material, such as butyl, molded silicone, natural rubber, isoprene, fluorocarbon-based fluoroelastomer materials (FKM), or any combination thereof. In some embodiments, plug 201 can be manufactured using bromobutyl rubber, chlorobutyl rubber, or molded halogenated butyl (or halobutyl) rubber. Halogenated butyl can include bromobutyl and chlorobutyl. In some embodiments, a plug height 206 of plug 201 can be in a range of about 5 mm to about 20 mm, e.g., about 10 mm to about 15 mm. Plug 201 can include a plug cavity 202, which can extend through (i.e., a through hole) and be coaxial with plug 201. Plug cavity 202 can allow a probe to access the materials in the container. In some embodiments, a width of plug cavity 202 can be a range of about 1 mm to 15 mm, e.g., about 2 mm to 10 mm.

In some embodiments, an insert 203 can be disposed within plug 201. In some embodiments, insert 203 can be positioned (e.g., using a compression fit, an adhesive, one or more restraints, or another suitable method) within plug 201 (e.g., as shown in FIG. 2A) during assembly of the stopper. The disclosed embodiments are not limited to inserts made from a particular material or combination of materials. In some embodiments, insert 203 can be plastic. In some embodiments, insert 203 can be manufactured using a suitable polymeric material (e.g., high-density polyethylene, polypropylene, cyclic olefin copolymer, or another suitable injection moldable plastic). Insert 203 can have an insert height 208 of 3 to 12 mm, e.g., about 5 to 8 mm. Insert 203 can include a portion having an outer surface that forms a seal with an inner surface of a corresponding portion of plug 201. In some embodiments, compression fit 211 can secure insert 203 within plug 201 (e.g., securing the outer surface of insert 203 against the inner surface of the corresponding portion of plug 201). In various embodiments, insert 203 can be bonded (e.g., using an adhesive, heat sealing, or the like), to the inner surface of plug 201. Insert 203 can include an upper opening 205 and a lower opening 209. The upper opening 205 can be larger than the lower opening 209 such that the probe accessing the interior of a container (e.g., the interior of container body 113) can be readily guided by a tapering sidewall of insert cavity 204 between the upper opening 205 and the lower opening 209. The lower opening 209 can be small (e.g., a size comparable to a probe's needle cross section size), such that the materials' exposure to insert cavity 204 and subsequently to the ambient environment through the penetration hole in membrane 207 is minimal. This reduced and indirect exposure to the ambient environment can reduce the likelihood of contamination and increase shelf life of the materials, as compared to a stopper lacking such a small lower opening 209. As examples, a width of the upper opening 205 can be in a range of about 2 mm to 14 mm, e.g., about 4 mm to 9 mm; and a width of the lower opening 209 can be in a range of about 0.5 mm to 3.0 mm, e.g., about 1 mm to 2 mm. Other suitable sizes can be used for the upper and lower openings to allow use of the disclosed embodiments with various sizes of containers and/or probes.

Consistent with disclosed embodiments, insert cavity 204 can be formed within insert 203 between pierceable membrane 207 and lower opening 209. In some embodiments, insert cavity 204 can be coaxial with plug 201 (or coaxial with plug cavity 202). In some embodiments, the inner surface of insert 203 can form walls of insert cavity 204. Upper opening 205 can form a top opening of insert cavity 204 and lower opening 209 can form a bottom opening of insert cavity 204. In some embodiments, a sidewall of insert cavity 204 can taper in from the top opening to the bottom opening of insert cavity 204. During aspiration of material from or deposition of material into the interior of container body 113, the aspirating or depositing probe can be advanced through insert cavity 204 into the container. Insert cavity 204 can assist in isolating the interior of the interior of container body 113 from the external environment.

In some embodiments, pierceable membrane 207 can seal the container (e.g., by sealing that portion of the opening of the container that remains unsealed by the plug). For example, the pierceable membrane 207 seals the upper opening 205 of insert 203. A portion of membrane 207 can overlap and be bonded to a corresponding portion of insert 203. In some embodiments, membrane 207 can include multiple layers of different materials. Constructing membrane 207 using multiple layers can enable selection of layers having different desired characteristics. For example, one layer of membrane 207 can be selected based on permeability and another layer of membrane 207 can be selected based on the ability to bond to insert 203.

In some embodiments, pierceable membrane 207 can include an upper impermeable layer and a lower bonding layer. In some embodiments, the lower bonding layer (e.g. an adhesive layer, heat-sealable polymer layer, or the like) can be the bottom layer of pierceable membrane 207. In some embodiments, additional layers can be disposed above the lower bonding layer. For example, one such additional layer (e.g., a polymer layer, or the like) can provide structural strength or support to pierceable membrane 207. This additional layer can be disposed between the upper impermeable layer and the lower bonding layer, or above the upper impermeable layer.

In some embodiments, the pierceable membrane 207 can include an upper metal layer and a lower polymer layer. The upper metal layer can exhibit reduced permeability and the lower polymer layer can be suitable for bonding to insert 203. In some embodiments, the metal layer can be a metal film, such as an aluminum film. In some embodiments, the polymer layer can be polypropylene, polyethylene, polyethylene terephthalate (PET) nylon, thermoplastic adhesive, or another suitable polymer. In various embodiments, membrane 207 can be a laminated metal film or a metallized film. In some embodiments, membrane 207 can be bonded using an adhesive (e.g., an adhesive applied to insert 203 or membrane 207, or an adhesive layer of membrane 207). In various embodiments, membrane 207 can be heat-sealed to insert 203. Such bonding can be performed before or after the insert in placed in plug cavity 202. In some embodiments, an impermeable polymer layer can be used in place of the upper metal layer.

Consistent with disclosed embodiments, plug 201 can include cutouts, such as cutout 213. Such cutouts can extend through the sides of plug 201. In some applications, such cutouts can provide an egress path for sublimated vapor during lyophilization.

Figure 2B:
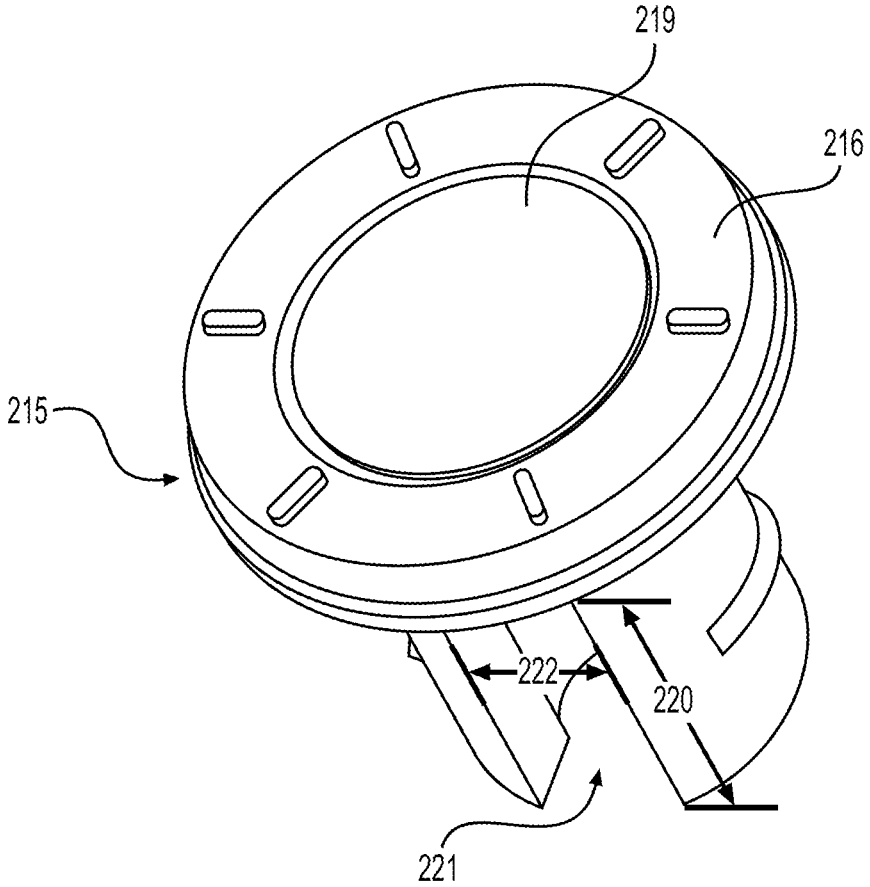
FIG. 2B depicts an oblique view of an exemplary sealing system similar to the system of FIG. 2A, consistent with the embodiments of the present disclosure.

FIG. 2B is an oblique view of an exemplary sealing system similar to the system of FIG. 2A, consistent with the embodiments of the present disclosure. This view of the exemplary sealing system depicts a plug and pierceable membrane 219. In this example, the plug is configured to seal a container having a cylindrical neck (e.g., container neck 112, or the like). As may be appreciated, the disclosed embodiments are not limited to containers having cylindrical necks. The disclosed embodiments can be used with container necks having other cross-sections or having tapers or longitudinally varying cross-sections. In this example, plug 215 has a cylindrical outer wall and a central plug cavity (e.g., plug cavity 202, or the like). Plug 215 includes flange portion 216 surrounding a recessed shelf portion (in this example covered by membrane 219). In some embodiments, an insert (e.g., insert 203, or the like) can be positioned in the recessed shelf portion of plug 215. Membrane 219 can be bonded to such an insert, thereby covering the top opening of the insert and sealing the central plug cavity. As depicted below with regards to FIGS. 4A to 4C, a plug can include zero or more cutouts. As depicted in FIG. 2B, plug 215 includes a cutout 221 having a cutout height 220 between 2 and 12 mm, e.g., 5 and 6 mm, and a cutout width 222 between 1 and 15 mm, e.g., 3 and 7 mm, or arc between 10 and 120 degrees. In some embodiments, another similar cutout can be disposed on the reverse side of the stopper. During lyophilization, the stopper may not be in the seal position but may protrude from the neck of the container such that cutout 221 provides an egress path from the container for sublimated vapor. Once lyophilization is complete, the stopper can be pushed further into the neck of the container, sealing the container.

Figure 2C:
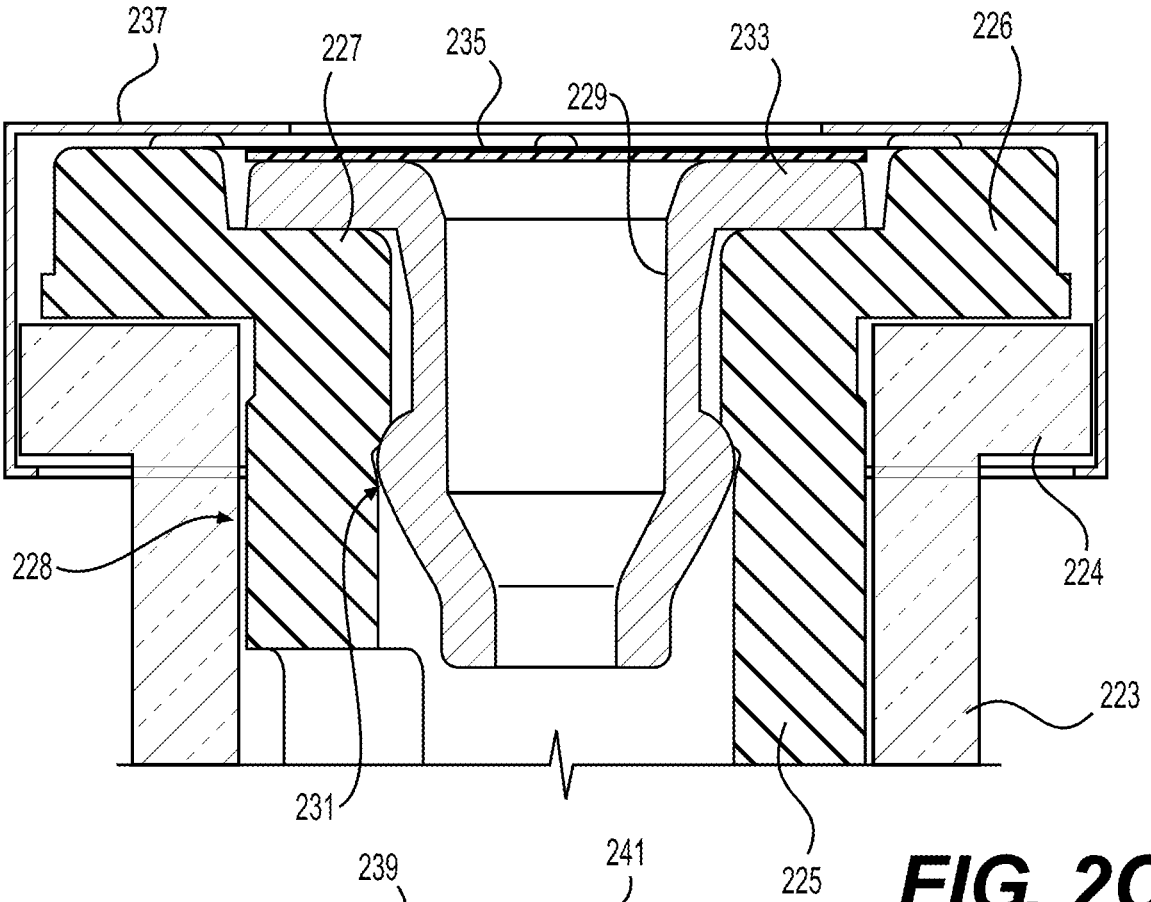
FIG. 2C depicts details of another exemplary sealing system including a plug, membrane, insert, and cap, consistent with disclosed embodiments.

FIG. 2C depicts details of another exemplary sealing system including a stopper and cap 237, consistent with disclosed embodiments. The exemplary sealing system is depicted as sealing a container having a container neck 223 that ends in a container flange 224. The stopper is disposed within container neck 223. The stopper includes plug 225, insert 229, and pierceable membrane 235. Plug 225 includes a plug flange 226 and a recessed shelf 227.

Consistent with disclosed embodiments, plug 225 can be configured to conform to an interior wall of container neck 223. In some embodiments, plug 225 can be dimensioned such that a compression fit 228 maintains plug 225 within container neck 223, regardless of the shape and size of the container neck. In some embodiments, plug 225 can form a seal with container neck 223.

Consistent with disclosed embodiments, a lower surface of plug flange 226 can contact an upper surface of container flange 224. In some embodiments, plug flange 226 can form a seal with container flange 224.

Consistent with disclosed embodiments, a recess in the upper surface of plug 225 can form shelf 227. In some embodiments, shelf 227 can be configured to receive insert flange 233. A bottom surface of insert flange 233 can contact a top surface of shelf 227. The dimensions of shelf 227 (e.g., depth and width) can correspond to the dimensions of insert flange 233. In some embodiments, shelf 227 can have a depth in a range between about 0.25 mm to about 5 mm, e.g., 1 mm to 2 mm. In some embodiments, shelf 227 can have a width (e.g., an annular ring width, or the like) of 3 to 20 mm, e.g., 8 mm to 12 mm. In some embodiments, when insert flange 233 is an annulus, shelf 227 can include a corresponding annular recessed shelf. In various embodiments, when insert flange 233 comprises multiple tabs or projections, shelf 227 can comprise multiple corresponding recesses. In some embodiments, the depth of shelf 227 can be selected such that insert flange 233 (or membrane 235) does not project above shelf 227. In various embodiments, the depth of shelf 227 can be selected such that cap 237 compresses insert flange 233 into shelf 227, forming a seal between shelf 227 and insert flange 233.

Consistent with disclosed embodiments, insert 229 can be disposed within plug 225. In some embodiments, insert 229 can be secured within plug 225 using restraints. One or more such restraints can be attached to or integrally molded into insert 229 (e.g., restraint 231). In some embodiments, plug 225 can be formed with recess(es) corresponding to these restraint(s). The restraint(s) on insert 229 can interlock with the recess(es) on plug 255 to secure insert 229 to plug 225. Alternatively or additionally, restraint(s) on insert 229 can lack corresponding recess(es) on plug 225. Instead, these restraint(s) can form a compression fit that secures insert 229 to plug 255. In some embodiments, the one or more restraints can be attached or integrally molded into plug 225. The corresponding recess(es) can be formed on insert 229. Additionally or alternatively, insert 229 can be secured within plug 225 using adhesives or a compression fit.

Consistent with disclosed embodiments, pierceable membrane 235 can be located over insert 229. In some embodiments, membrane 235 can be bonded to insert flange 233 of insert 229 (e.g., bonded adhesively, heat-sealed, or in another suitable manner).

Optionally, cap 237 can be disposed around the container neck 223 and the stopper. The disclosed embodiments are not limited to caps made using any particular material or combination of materials. In some embodiments, cap 237 can be made from metal, polymer, or another suitable material. In some embodiments, cap 237 can be crimped around container flange 224, as depicted in FIG. 2C. In various embodiments, cap 237 can include a threaded portion, which can screw onto corresponding threads of a matching threaded portion on container flange 224 (or container neck 223, or the like). In some embodiments, cap 237 can include a first portion formed around container neck 223 and a second portion that hooks or snaps into the first portion, thereby closing around neck 223 and the stopper. Cap 237 can include an opening positioned over at least a portion of membrane 235 of the stopper. During aspiration or deposition of material, the aspirating or depositing probe can be advanced through the opening in cap 237 and membrane 235.

The disclosed embodiments are not limited to embodiments in which the stopper seals the container. In some embodiments, cap 237 can be configured to seal the container by compressing insert flange 233 against shelf 227, or by compressing plug flange 226 against container flange 224. In some embodiments, a portion of cap 237 can overlap with a portion of insert 229, such that cap 237 can apply a compressive force to insert 229. In such embodiments, this compressive force can secure (or assist in the securing of) insert 229 within plug 225, or seal insert 229 against plug 225 (e.g., seal insert flange 233 against plug flange 226). In some embodiments, cap 237 can be configured to prevent the stopper from becoming dislodged.

Consistent with disclosed embodiments, a displaceable secondary cover for pierceable membrane 239 (not depicted in FIG. 2C) can cover the opening in cap 237. The secondary cover can be configured to prevent contact with (or damage to) membrane 239 through the opening in cap 237. In some embodiments, the secondary cover can include a removeable tab (e.g., a peel-away tab, or the like) or removeable insert (e.g., a snap-in insert, or the like) that blocks the opening in cap 237. In various embodiments, the secondary cover can be a lid that closes to cover the opening in cap 237. The lid can be part of cap 237 or separate from cap 237.

Figure 2D:
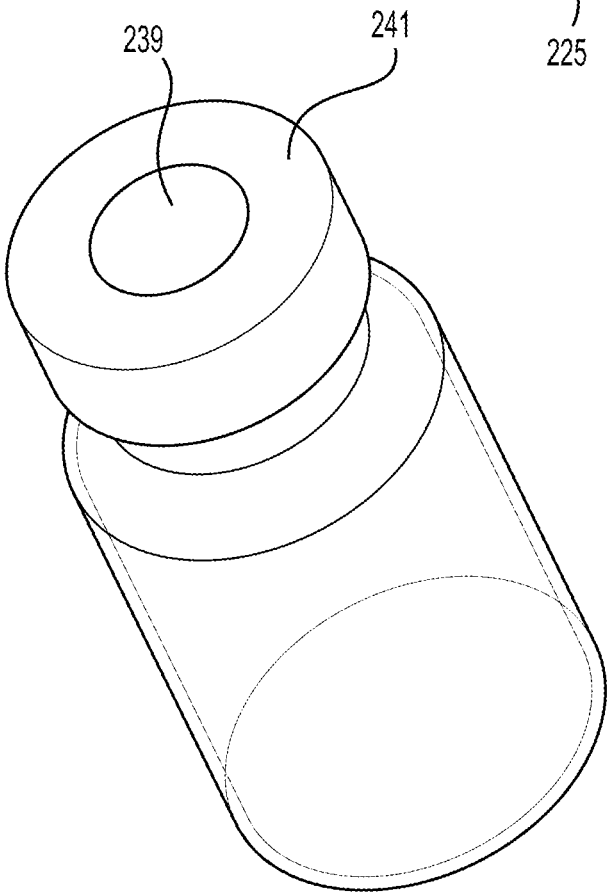
FIG. 2D depicts an oblique view of an exemplary sealing system similar to the system of FIG. 2C, consistent with the embodiments of the present disclosure.
Figure 3A:
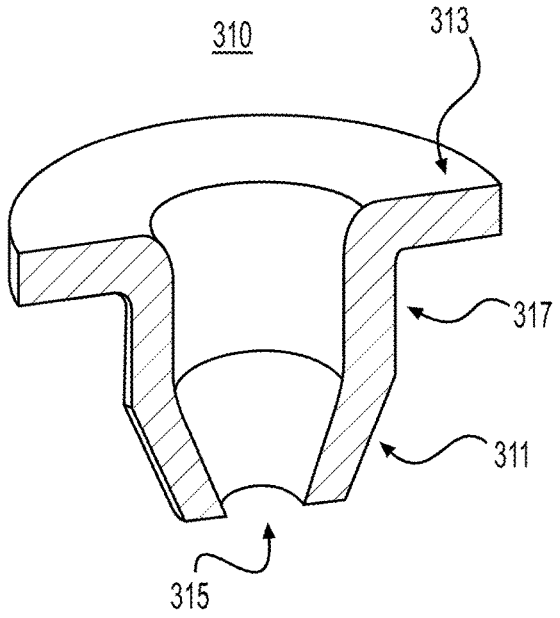
FIGS. 3A to 3F depict various inserts suitable for use with the exemplary sealing systems of FIGS. 2A and 2C, consistent with the embodiments of the present disclosure.
Figure 3B:
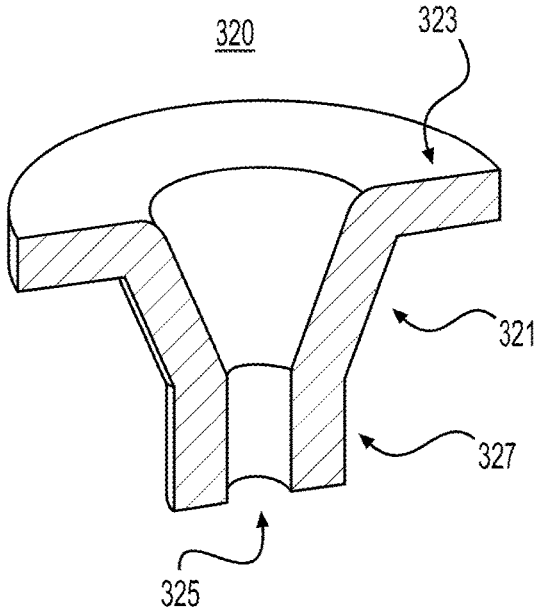
Figure 3C:
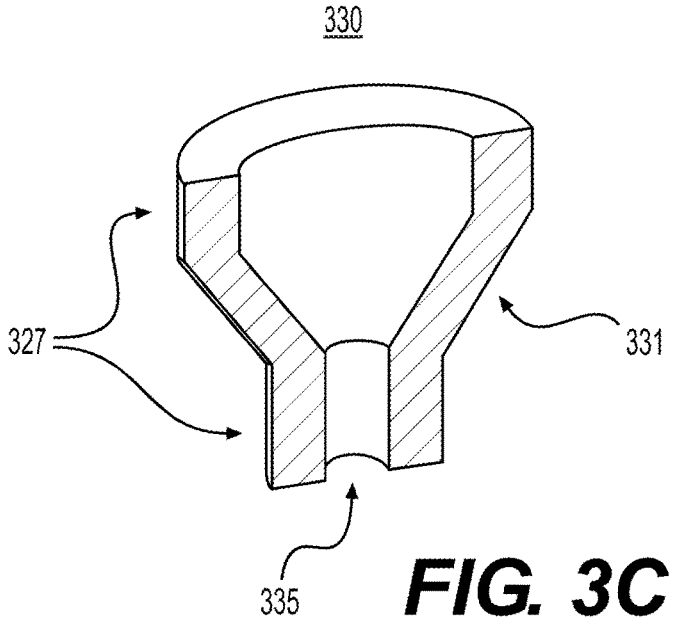
Figure 3D:
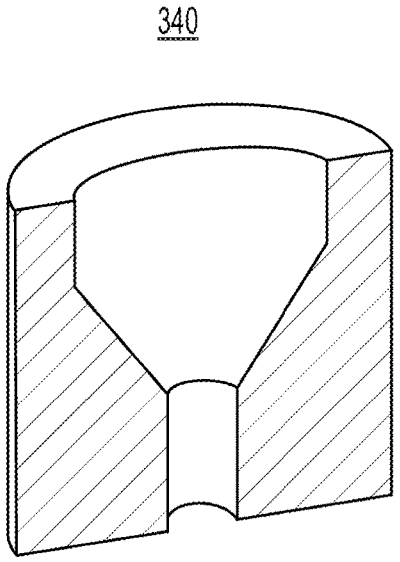
Figure 3E:
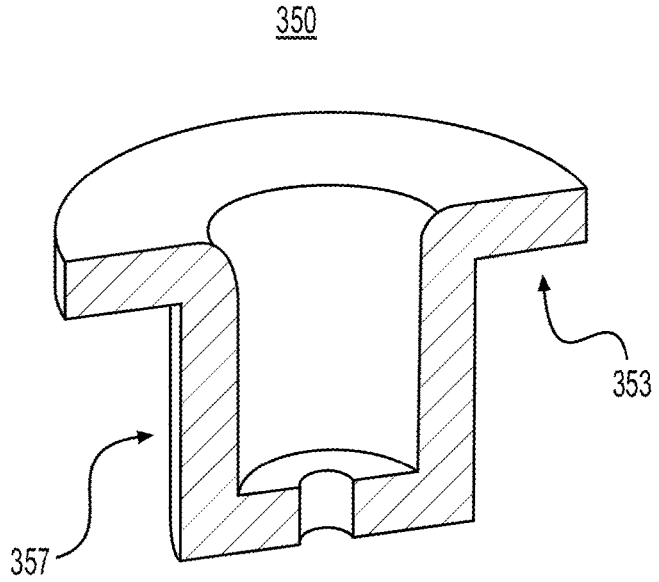
Figure 3F:
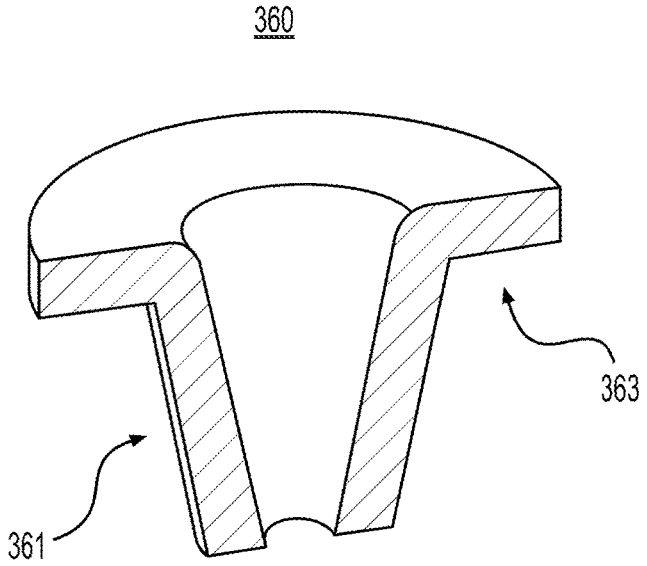

FIG. 2D depicts an oblique view of an exemplary sealing system similar to the system of FIG. 2C, consistent with disclosed embodiments. In this example, the container is cylindrical with a cylindrical container neck. Cap 241 is crimped over a stopper disposed within cap 241. Cap 241 includes a circular opening through which pierceable membrane 239 is accessible. The circular opening in cap 241 can be smaller than membrane 239 (and therefore smaller than the insert covered by membrane 239). Cap 241 can therefore compress the membrane-covered insert against the plug portion of the stopper.

FIGS. 3A to 3F depict various exemplary inserts suitable for use with the exemplary sealing systems of FIGS. 2A and 2C, consistent with the embodiments of the present disclosure. These inserts include various combinations of taper configuration, the presence or absence of insert flanges, and outer wall geometries. The depicted inserts indicate certain dimensions along which the disclosed embodiments can vary and are not themselves intended to be limiting. While the depicted inserts have a circular cross-section, the disclosed embodiments include embodiments having other cross-sections, such as oval, square, rectangular, irregular, or other non-circular cross-sections.

Consistent with disclosed embodiments, insert 310 includes an insert flange 313. The walls of insert 310 include a tapering portion 311 that ends in a lower opening 315 and a vertical portion 317 that connects to insert flange 313. Both the outer and inner walls of insert 310 taper.

Consistent with disclosed embodiments, insert 320 includes an insert flange 323. The walls of insert 320 include a tapering portion 321 connected to insert flange 323 and a vertical portion 327 the ends in a lower opening 325. Both the outer and inner walls of insert 320 taper.

Consistent with disclosed embodiments, insert 330 does not include an insert flange. In embodiments using an insert that lacks an insert flange, the plug (e.g., plug 225 or the like) may lack a recessed shelf (e.g., shelf 227 or the like). The walls of insert 330 include a tapering portion 331 disposed between two vertical portions 337, one of which ends in a lower opening 335. Both the outer and inner walls of insert 330 taper.

Consistent with disclosed embodiments, insert 340 does not include an insert flange. Furthermore, unlike inserts 310 to 330, the outer wall of insert 310 does not taper. Instead, an outer diameter of insert 340 remains approximately constant, while the inner wall of insert 340 tapers. In some embodiments, the constant diameter of insert 340 may support an improved seal between insert 340 and a plug containing insert 340.

Consistent with disclosed embodiments, insert 350 includes an insert flange 353. Unlike inserts 310 to 340, insert 350 includes a single vertical portion 357 but does not include a taper. Similar to insert 340, the constant diameter of insert 350 may support an improved seal between insert 350 and a plug containing insert 350. Furthermore, insert 350 may be simpler to manufacture than an insert that include tapering walls.

Consistent with disclosed embodiments, insert 360 includes an insert flange 356. Unlike inserts 310 to 350, insert 360 does not include a vertical portion but does includes taper 361. In some instances, insert 360 may provide a steeper interior wall angle for a given stopper height and diameter. The steeper interior wall angle may provide superior alignment capabilities for probes passing through insert 360.

The envisioned embodiments are not limited to embodiments including an insert. In some embodiments, the pierceable membrane may be bonded directly to the plug. In some such embodiments, the plug can be molded (and/or shaped) to include an upper opening and a lower opening formed, for example, by tapering the inner plug wall(s) to provide a plug cavity similar in shape to the insert cavities depicted in FIGS. 1, 2A, and 2C. In some such embodiments, the walls of the plug can be molded (and/or shaped) similar in shape to the inner walls of the inserts depicted in FIGS. 3A to 3F.

Figure 5A:
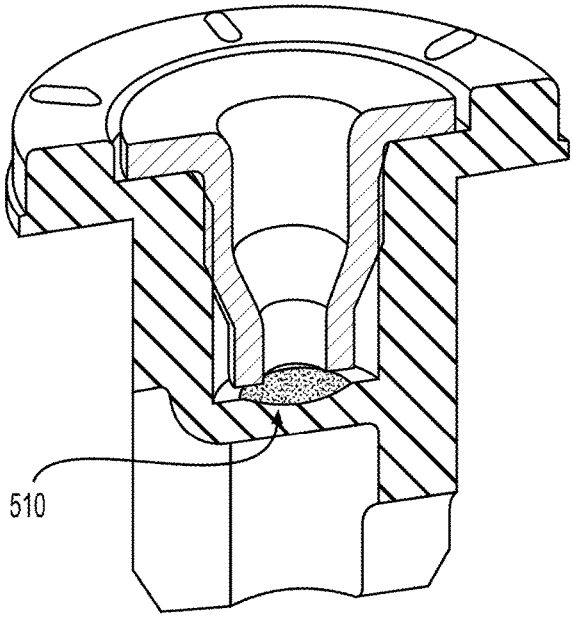
FIGS. 5A to 5C illustrate plugs that include a diaphragm that provides a barrier between the interior of the container and the ambient environment, consistent with disclosed embodiments.
Figure 5B:
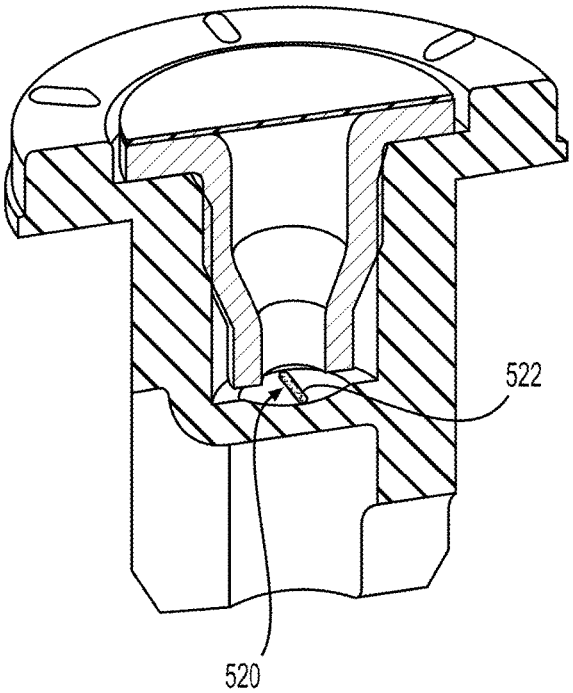
Figure 5C:
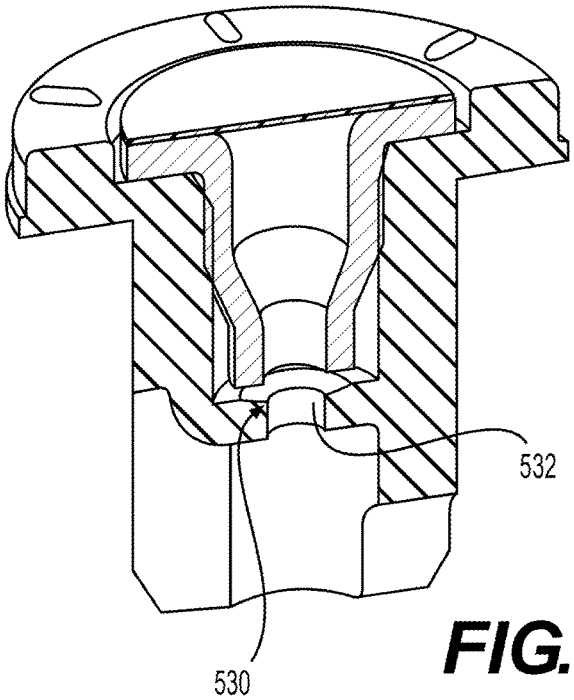

In some such embodiments, the plug can be molded (and/or shaped) to include an upper opening and a lower opening formed by a constriction or a diaphragm as disclosed herein with regards to FIGS. 5A to 5C. The plug cavity can then form part of a tortuous path between the ambient environment and the interior of the container (e.g., through the membrane, the plug cavity, and the lower opening into the interior of the container). Such embodiments may be simpler to fabricate or require a less complicated manufacturing process than embodiments including an insert separately made from the plug.

Envisioned embodiments that include an insert are not limited to embodiments in which the pierceable membrane is bonded to the insert. In some embodiments that include an insert, the membrane may be bonded directly to the plug. For example, the membrane can be bonded to an upper surface of the plug above the recessed shelf (e.g., shelf 227, or the like) that contains the insert flange (e.g., insert flange 233, or the like). As an additional example, the membrane can be bonded to the cap, as opposed to being bonded to the insert or the plug. Accordingly, in some embodiments, the membrane can be over the insert and bonded to the insert (e.g., as in FIGS. 2A and 2C), while in various embodiments, the membrane can be over the insert but not bonded to the insert.

Figure 4A:
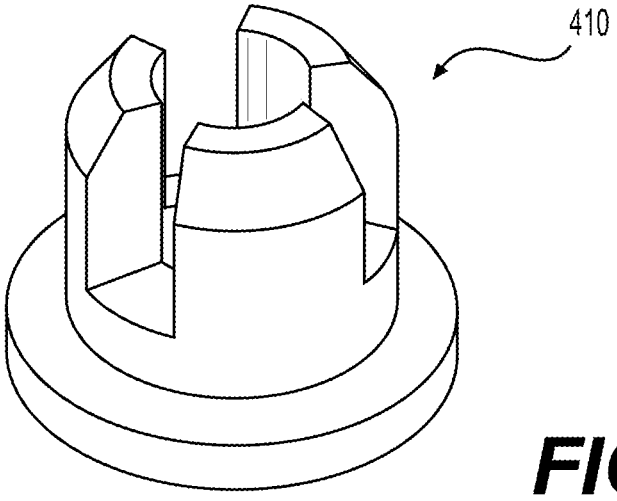
FIGS. 4A to 4C depict various plugs suitable for use with the exemplary sealing systems of FIGS. 2A and 2C, consistent with the embodiments of the present disclosure.
Figure 4B:
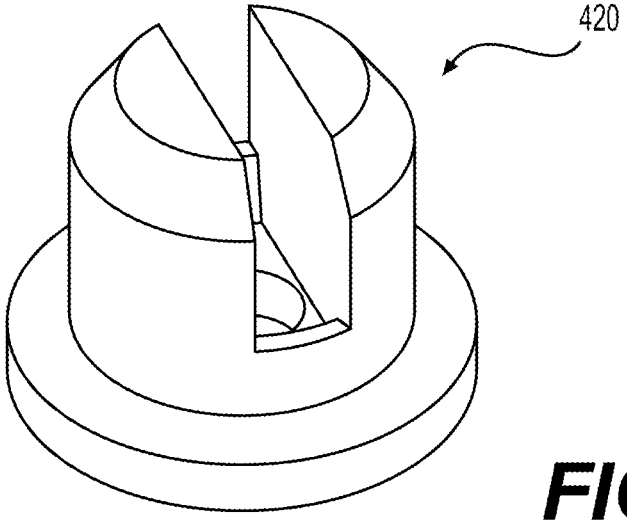
Figure 4C:
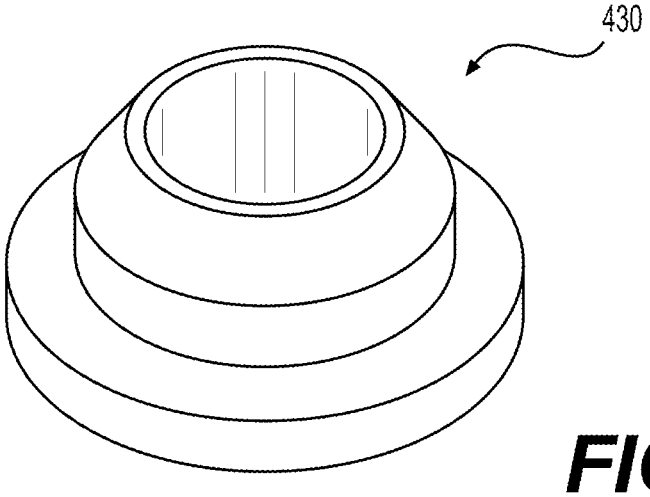

FIGS. 4A to 4C depict various exemplary plugs suitable for use with the exemplary sealing systems of FIGS. 2A and 2C, consistent with the embodiments of the present disclosure. As may be appreciated, the insert (e.g., insert 140 or the like) can align or support the probe during aspiration or dispensing of material. Accordingly, the design of the plug may vary to accommodate other design criteria. FIG. 4A depicts a plug including three separate cutouts and FIG. 4B depicts a plug including two separate cutouts. In some applications, such cutouts can enable vapor to escape the container during lyophilization. Such cutouts can also be varied in dimension to adjust the force required to insert the plug into the container neck. The depicted plugs also include restraints formed on the sides of the plugs. Such restraints can assist retention of the plug in the container neck. In contrast, FIG. 4C depicts a plug lacking cutouts.

FIGS. 5A to 5C depict stoppers that include a diaphragm, consistent with disclosed embodiments. In some embodiments, the diaphragm can provide an additional barrier between the interior of the container and the ambient environment. The diaphragm can be formed as part of the plug (e.g., plug 201, or the like). The diaphragm can obturate the plug cavity (e.g., plug cavity 202, or the like). In some embodiments, as depicted in FIGS. 5A to 5C, the diaphragm can be positioned below the insert (e.g., below the lower opening of the insert). Thus a probe that is aspirating or dispensing material may necessarily pass through the diaphragm in order enter into the interior of the container (e.g., the interior of container body 113, or the like).

In some embodiments, as depicted in FIG. 5A, the diaphragm 510 can be solid prior to the initial entry of the probe. In such embodiments, the probe can penetrate the diaphragm. The diaphragm can be created from a self-sealing material (e.g., an elastomeric rubber material, or the like). The diaphragm can seal once the probe is removed, further reducing the exposure of material in the container to the ambient environment. In the depicted embodiment, the pierceable membrane is absent. But solid diaphragms can be used with embodiments including the pierceable membrane.

In some embodiments, as depicted in FIG. 5B, the diaphragm 520 can be pre-sliced during the manufacturing of the plug. Slice 522 can be located below the lower opening of the insert. Alternatively, as depicted in FIG. 5C, the diaphragm 530 can be pre-pierced (e.g., piercing 532, normally closed but depicted in an open state for clarity) during the manufacturing of the plug. Slice 522 or piercing 532 can be introduced in the diaphragm to enable the probe to enter the container without having to penetrate the diaphragm. Instead, the probe can push through the sliced or pierced portion of the diaphragm. Because the probe need not repeatedly penetrate the diaphragm, coring and fragmentation from the diaphragm can be reduced or prevented with a pre-pierced or pre-sliced diaphragm.

As described above, in some embodiments the stopper may not include the insert. In such embodiments, a cavity can be formed between the pierceable membrane and the pre-sliced or pre-pierced diaphragm. The lower opening bounding the cavity can be formed by the pre-sliced or pre-pierced diaphragm (or the penetrated diaphragm following introduction of the probe into the container).

The embodiments may further be described using the following clauses:

1. A sealing system for a container, comprising: a plug configured to conform to an inner wall of a neck of a container, a first cavity extending through the plug, the first cavity being coaxial with the plug; an insert disposed within the first cavity; and a membrane over the insert, the membrane sealing a top opening of a second cavity formed within the first cavity between the insert and the membrane.
2. The sealing system of clause 1, wherein: a wall of the second cavity tapers between the top opening and a bottom opening of the second cavity.
3. The sealing system of any one of clauses 1 to 2, wherein: the insert is secured to the plug within the first cavity using an adhesive, restraints formed in an outer wall of the insert or an inner wall of the first cavity, or a compression fit between the outer wall of the insert and the inner wall of the first cavity.
4. The sealing system of any one of clauses 1 to 3, wherein: the membrane comprises an upper metal layer and a lower polymer layer bonded to the insert.
5. The sealing system of any one of clauses 1 to 4, wherein: the membrane comprises a laminated metal film or a metallized film.
6. The sealing system of any one of clauses 1 to 5, wherein: a top surface of the plug comprises a recessed shelf surrounding a top opening of the first cavity; and the insert comprises an insert flange surrounding the top opening of the second cavity, a top surface of the insert flange bonded to the membrane, and a bottom surface of the insert flange contacting a top surface of the recessed shelf.
7. The sealing system of clause 6, the sealing system further comprising: a cap configured to compress the insert flange against the recessed shelf to seal the container.
8. The sealing system of any one of clauses 1 to 7, the sealing system further comprising: a cap configured to secure the insert within the first cavity, the cap fastened around the neck of the container and including an opening above at least a portion of the membrane.
9. The sealing system of clause 8, wherein: the cap includes a displaceable secondary cover for the membrane.
10. The sealing system of any one of clauses 1 to 9, wherein: the plug includes a diaphragm disposed below the insert that obturates the first cavity.
11. The sealing system of clause 10, wherein: the diaphragm is pre-sliced or pre-pierced.

12. The sealing system of any one of clauses 1 to 11, wherein: the plug portion includes one or more cutouts.

13. A stopper, comprising: a plug configured to conform to an inner wall of a neck of a container, the plug including one or more walls forming a cavity having an upper opening and a lower opening, where the upper opening is larger than the lower opening, and a pierceable membrane covering an upper opening of the cavity, where the pierceable membrane comprises a material different from one or more materials of the plug.

14. The stopper of clause 13, wherein: the pierceable membrane is bonded to the plug.

15. The stopper of clause 13, wherein: the cavity is bounded by a plastic insert disposed within the plug, the plastic insert comprising the lower opening and an insert flange; and the pierceable membrane is bonded to an upper surface of the insert flange.

16. The stopper of any of clause 15, wherein: the plastic insert is secured within the plug by an adhesive, restraints formed in an outer wall of the plastic insert or an inner wall of the plug, or a compression fit between the outer wall of the insert and the inner wall of the plug.

17. The stopper of any one of clauses 13 to 16, wherein: the pierceable membrane comprises a laminated metal film or a metallized film.

18. The stopper of any one of clauses 13 to 17, wherein: the cavity tapers between the pierceable membrane and the lower opening.

19. The stopper of any one of clauses 13 to 18, wherein: the plug includes a diaphragm, the diaphragm obturating the lower opening.

20. The stopper of any one of clauses 13 to 19, wherein: the diaphragm is pre-sliced or pre-pierced.

Moreover, while illustrative embodiments have been described herein, the scope includes any and all embodiments having equivalent elements, modifications, omissions, combinations (e.g., of aspects across various embodiments), adaptations or alterations based on the present disclosure. The elements in the claims are to be interpreted broadly based on the language employed in the claims and not limited to examples described in the present specification or during the prosecution of the application, which examples are to be construed as non-exclusive. Further, the steps of the disclosed methods can be modified in any manner, including by reordering steps or inserting or deleting steps. It is intended, therefore, that the specification and examples be considered as example only, with a true scope and spirit being indicated by the following claims and their full scope of equivalents.

What is claimed is:

1. A sealing system for a container, comprising:

a plug configured to conform to an inner wall of a neck of the container, a first cavity extending through the plug, the first cavity being coaxial with the plug;

an insert disposed within the first cavity; and a membrane over the insert, the membrane sealing a top opening of a second cavity formed within the first cavity between the insert and the membrane;

wherein a top surface of the plug comprises a recessed shelf abutting a top opening of the first cavity; and wherein the insert comprises an insert flange, a bottom surface of the insert flange contacting a top surface of the recessed shelf, and a top surface of the insert flange is bonded to the membrane.

2. The sealing system of claim 1, wherein:

a wall of the second cavity tapers between the top opening and a bottom opening of the second cavity.

3. The sealing system of claim 1, wherein:

the insert is secured to the plug within the first cavity using an adhesive, restraints formed in an outer wall of the insert or an inner wall of the first cavity, or a compression fit between the outer wall of the insert and the inner wall of the first cavity.

4. The sealing system of claim 1, wherein:

the membrane comprises an upper metal layer and a lower polymer layer bonded to the insert.

5. The sealing system of claim 1, wherein:

the membrane comprises a laminated metal film or a metallized film.

6. The sealing system of claim 1, the sealing system further comprising:

a cap configured to compress the insert flange against the recessed shelf to seal the container.

7. The sealing system of claim 3, wherein a restraint is attached to or integrally molded into the insert.

8. The sealing system of claim 1, wherein:

the plug and the insert comprise different materials.

9. The sealing system of claim 8, wherein:

the plug comprises an elastomeric material.

10. The sealing system of claim 1, wherein:

the insert comprises plastic.

11. A stopper comprising:

a plug configured to conform to an inner wall of a neck of a container, the plug comprising (i) one or more walls forming a cavity having an upper opening and a lower opening and (ii) a recessed shelf abutting the upper opening, where the upper opening is larger than the lower opening, a pierceable membrane covering the upper opening of the cavity, where the pierceable membrane comprises a material that is different from one or more materials of the plug; and a plastic insert within the cavity, the plastic insert comprising an insert flange;

wherein a bottom surface of the insert flange contacts a top surface of the recessed shelf.

12. The stopper of claim 11, wherein:

the pierceable membrane is bonded to the plug.

13. The stopper of claim 11, wherein:

the pierceable membrane is bonded to an upper surface of the insert flange.

14. The stopper of claim 13, wherein:

the plastic insert is secured within the plug by an adhesive, restraints formed in an outer wall of the plastic insert or an inner wall of the plug, or a compression fit between the outer wall of the plastic insert and the inner wall of the plug.

15. The stopper of claim 11, wherein:

the pierceable membrane comprises a laminated metal film or a metallized film.

16. The stopper of claim 11, wherein the plastic insert defines a second cavity that tapers between the pierceable membrane and a lower opening.

17. The stopper of claim 11, wherein:

the plug comprises an elastomeric material.

18. The stopper of claim 14, further comprising a restraint is attached to, or integrally molded into, the insert.

* * * * *